US005582306A

United States Patent [19]

Balter et al.

[11] Patent Number: 5,582,306

[45] Date of Patent: Dec. 10, 1996

[54] CLOSET ORGANIZER

[75] Inventors: Neil T. Balter, Las Vegas, Nev.; Kevin Harrington, Belaire, Fla.

[73] Assignee: Organizers Direct, L.L.C., Scottsdale, Ariz.

[21] Appl. No.: 463,318

[22] Filed: Jun. 5, 1995

[51] Int. Cl.[6] ..... A47B 57/00

[52] U.S. Cl. ..... 211/187; 211/90; 211/105.1

[58] Field of Search ..... 211/187, 189, 211/188, 186, 90, 105.1, 123; 312/245, 242, 265.5

[56] References Cited

U.S. PATENT DOCUMENTS

| | | | |
|---|---|---|---|
| Re. 34,570 | 3/1994 | Fromkin . | |
| 189,918 | 4/1877 | Brinkerhoff . | |
| 744,701 | 11/1903 | Pederson . | |
| 1,398,071 | 11/1921 | Forester . | |
| 2,213,115 | 8/1940 | Bales . | |
| 2,657,894 | 11/1953 | Sklenar . | |
| 2,956,468 | 10/1960 | Macy . | |
| 3,099,931 | 8/1963 | Ferdinand . | |
| 3,317,056 | 5/1967 | Alpert | 211/187 X |
| 3,343,902 | 9/1967 | Magnuson | 312/245 X |
| 3,351,403 | 11/1967 | Magnuson | 312/245 |
| 3,471,112 | 10/1969 | MacDonald et al. . | |
| 3,637,183 | 1/1972 | Sagers . | |
| 3,765,295 | 10/1973 | Ptak . | |
| 3,846,002 | 11/1974 | Floetotto . | |
| 3,865,336 | 2/1975 | Robertson . | |
| 3,923,161 | 12/1975 | Kaiser et al. . | |
| 4,186,666 | 2/1980 | Honickman . | |
| 4,285,484 | 8/1981 | Follows . | |
| 4,688,687 | 8/1987 | Pryor . | |
| 4,693,383 | 9/1987 | Fenwick . | |
| 4,928,833 | 5/1990 | Huizenga . | |
| 5,191,986 | 3/1993 | Huizenga . | |
| 5,337,905 | 8/1994 | Gast . | |

FOREIGN PATENT DOCUMENTS

| | | | |
|---|---|---|---|
| 1231758 | 10/1960 | France | 211/188 |
| 1248557 | 10/1971 | United Kingdom . | |

*Primary Examiner*—Blair Johnson
*Attorney, Agent, or Firm*—Vidas, Arrett & Steinkraus

[57] ABSTRACT

A closet organizer including a central shelf tower having openings through its vertical members to support an adjustable length clothes pole, including clothes pole cup supports for holding the ends of the clothes pole to the closet walls.

4 Claims, 2 Drawing Sheets

CLOSET ORGANIZER

BACKGROUND OF THE INVENTION

1. Field of the Invention

This invention relates to pre-manufactured closet organizer system having a shelf tower and adjustable length clothes pole supported centrally by said tower.

2. Description of the Related Art

The traditional closet has a single clothes pole and a shelf above the clothes pole. One derivation is to place a single vertical support that allows a second, shorter clothes pole to be placed to provide more hanger space.

More involved approaches add sophisticated modules that add shelves, shoe racks, tie racks and the like. Examples are illustrated by U.S. Pat. No. 4,928,833 to Huizenga which issued May 29, 1990, U.S. Pat. No. 4,688,687 to Pryor which issued Aug. 25, 1987 and U.S. Pat. No. 5,337,905 to Gast which issued Aug. 16, 1994.

The largest drawback to prior art closet organizers is that they tend to be difficult to install without prior experience and many tools. Levels, saws, tape measures, drills, adhesives, screws and drills may be required. One miscut or mismeasurement may ruin the entire closet system. Cleats and baseboards must be pried from the walls, causing damage to the walls and requiring painting.

Consumers are in need of a cost-effective closet system that increases the useful space in their closet without requiring an engineering degree to install. In addition, the closet system should be readily relocated to a different closet if desired.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. §1.56(a) exists.

SUMMARY OF THE INVENTION

The invention provides a closet organizer that may be set up in minutes with no sawing or cutting, eliminating one of the most mistake-ridden areas a homeowner normally encounters. The closet organizer kit of the invention sets up in minutes, in any closet, with only the use of a screwdriver. It's infinite adjustability allows installation without measuring or cutting.

The closet organizer of the invention involves fabrication of a shelf tower, which may be constructed in or out of the closet. The tower includes several through holes into which a telescoping clothes pole is positioned. The tower is then moved into the closet, if not already so positioned.

The closet pole is expanded out until it reaches the opposing closet walls, where markings are made. The pole is then retracted so a clothes pole cup may be secured to the walls at the marked areas. Alternatively, a combination pole cup and shelf support may be secured to the walls. The clothes rod is then extended out until supported by the clothes pole cups. Preferably, the rod is secured to the cups to prevent undesired retraction of the pole. A pre-existing top shelf may then be placed onto the closet organizer to regain that surface.

The closet organizer can be assembled and installed without the use of a saw and does not require precise measurements or levels. For homeowners or renters, the organizer may move with them, since takedown is almost as easy as assembly.

Ordinarily, a telescoping pole would not be sufficiently strong to support the weight of many clothes unless made from very heavy weight steel. The support provided by the shelf tower allows the use of a much lighter and telescoping clothes pole since the span between supports is decreased.

BRIEF DESCRIPTION OF THE DRAWINGS

A detailed description of the invention is hereafter described with specific reference being made to the drawings in which.

DESCRIPTION OF THE PREFERRED EMBODIMENTS

Figure 1:
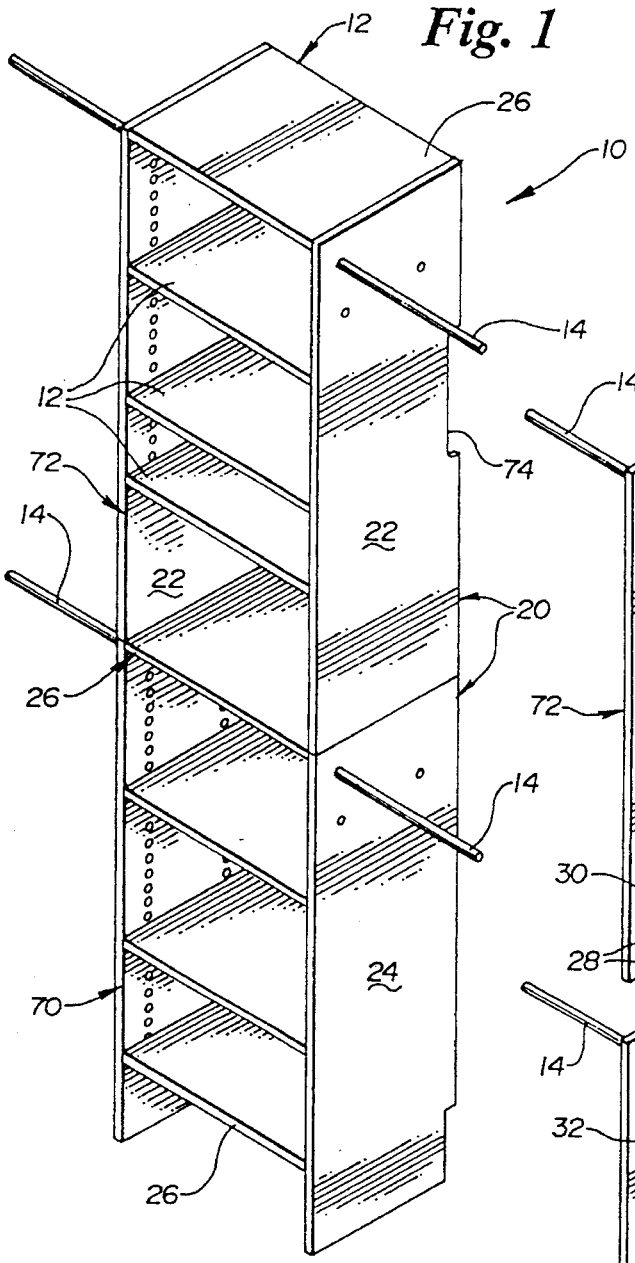
FIG. 1 is a perspective view of the closet organizer with a single shelf tower.
Figure 2:
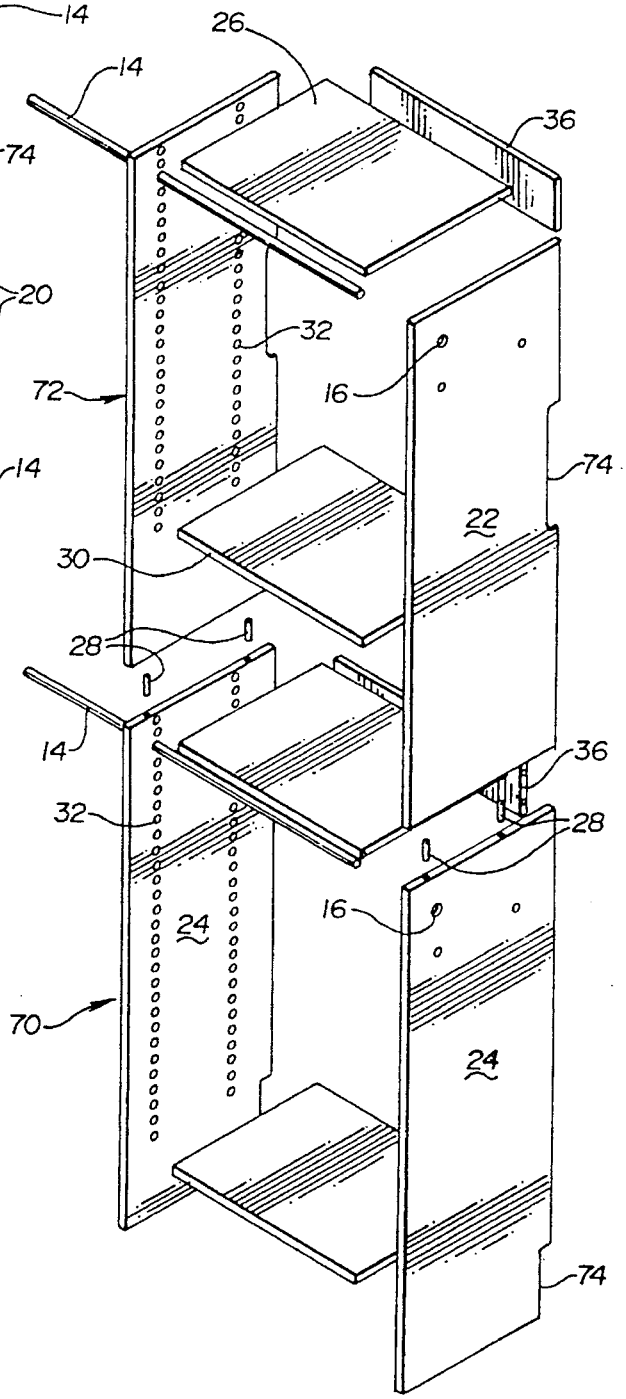
FIG. 2 is an exploded view thereof.

With reference to the figures, the closet organizer 10 is shown to include at least one shelf tower 12, at least one telescoping clothes pole or rod 14, and a pair of clothes pole cup supports for attachment to opposing closet walls for each clothes pole. Each of the clothes poles 14 extend through openings 16 that extend through each upright panel 20 of the shelf tower 12 and is supported thereby.

Figure 5:
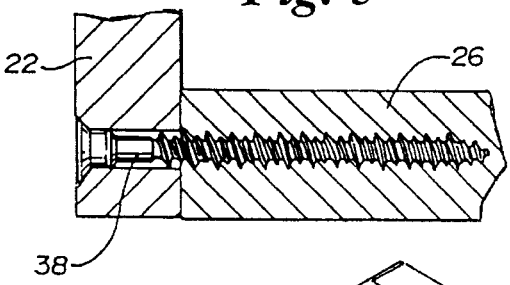
FIG. 5 is a fragmentary sectional detail thereof showing a fastener.

The invention will be described by stepping through the set-up of the pre-manufactured closet organizer to show that no cutting, sawing or removal of cleats and baseboards is required. The closet organizer of the invention is the only kit that requires only a screwdriver for installation. Each shelf tower 12 is preferably formed from upright panels 20 that include a top and bottom partition 22, 24 to decrease the size and weight of pieces for the user to handle. Accordingly, the user simply places a left and right bottom partition apart from each other and attaches them together via fixed shelves 26. The fixed shelves may be attached to the partitions in any acceptable manner. The method shown uses conventional hi-low screws 38 as shown in FIG. 5. Another method is to screw in end bolts into the partitions that can then mate with cam connecting fittings in the fixed shelves 26. Such systems involve pre-drilling of the necessary holes during manufacturing so the user simply inserts the end bolts, positions the shelves and turns the cam to lock.

Figure 6:
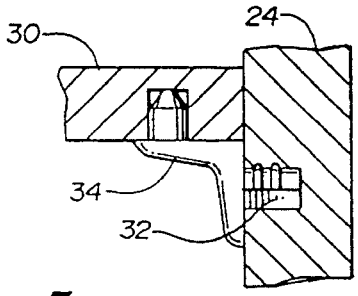
FIG. 6 is a fragmentary sectional detail view thereof showing a shelf support.

With the bottom portion 70 of the shelf tower assembled, the top portion 72 is assembled in a similar manner. The top 72 and bottom 70 may be joined with dowels 28 that connect the top and bottom partitions 22, 24 together. Adjustable shelves 30 may be added in between the fixed shelves 26 at any of a number of predrilled support holes 32 with shelf clips 34 as shown in FIG. 6.

The shelf tower 12 or towers are then moved into the closet such that they are positioned tightly against the back wall of the closet. Nailer boards 36 may be added to the top and bottom portions of the shelf towers with screws or the like to add a nailing surface to the closet wall. Note that cut-outs 74 may be formed in the partitions 22, 24 to accommodate baseboards, cleats and the like which do not need to be removed by virtue of the cut-outs 74.

The shelf towers 12 include pole openings 16 through each upright panel sized to accommodate a clothes pole 14. If room permits, the adjustable length, telescoping pole may be inserted through each pole opening 16 while the shelf tower is in the closet. If not, the clothes poles are inserted before the shelf towers are placed in the closet.

Figure 3:
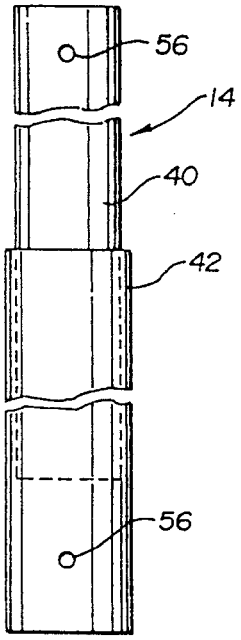
FIG. 3 is a side elevational view thereof of a telescoping rod.

The clothes pole 14 is an adjustable length pole without cutting. Preferably, the pole 14 is telescoping and includes a rod 40 which mates with a sleeve 42 as shown in FIG. 3. A 20 gauge steel pole provides excellent strength when supported at its ends at the pole cups and intermediately by the two upright panels of each tower.

Figure 4:
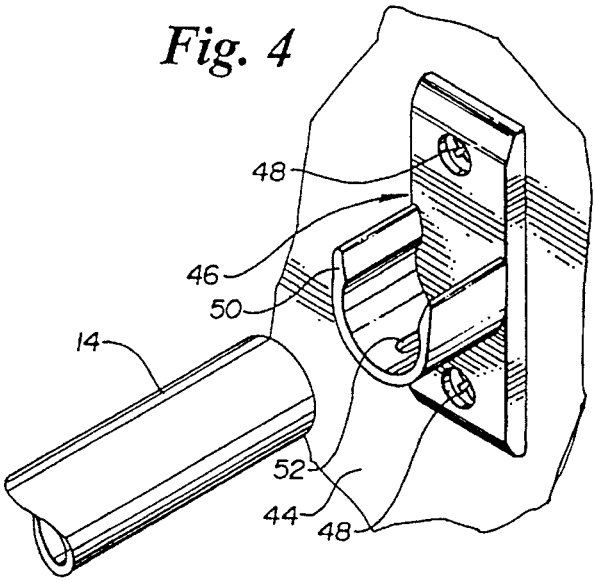
FIG. 4 is a fragmentary exploded perspective view thereof illustrating the rod and pole cup.

The clothes pole 14 is extended in the closet up against the opposing closet walls. The user then marks where the clothes poles 14 meet the wall 44, retracts the poles and attaches a pole cup support 46 at each position marked with a screw 48 or similar method depending on the wall. The pole cup support 46 includes a cup 50 into which the pole 14 rests as shown in FIG. 4. Preferably, cup 50 includes an opening 52 through which a screw (not shown) may be inserted into a mating opening 56 in the end of the clothes pole 14. This would lock the pole 14 in position and prevent accidental retraction of length.

Figure 7:
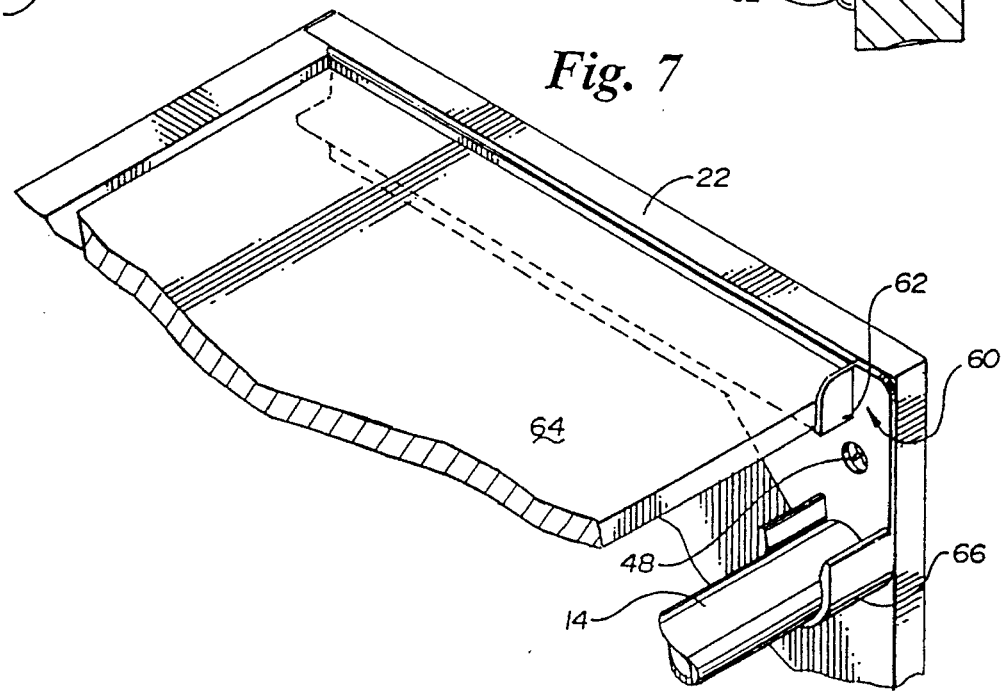
FIG. 7 is a perspective detail view thereof illustrating a plastic shelf/cup combination with a portion of a shelf showing.

As an alternative to pole cup support 46, the clothes pole 14 may be supported by a combination shelf support/pole cup bracket 60 as shown in FIG. 7. Such a bracket 60 includes a shelf support 62 for an elongated top shelf 64 extending the width of the closet and includes a pole cup 66 attached to a wall mounted bracket as shown. This allows the reuse of a pre-existing top shelf 64 at no cost to the user or the addition of a long, top shelf across the width of the closet. An alternative combination shelf support/pole cup is shown in U.S. Pat. No. 4,285,484 issued Aug. 25, 1981 to Follows.

It should be apparent by reading these assembly instructions that no cutting or precision measuring is required. Instead, only a screwdriver is required. A drill may be useful in forming the connections to concrete walls at the nailers and/or pole cup supports, but is not required for most walls.

Takedown of the closet organizer 10 is also very easy, allowing the user to relocate the unit in a different closet. It should be apparent that multiple shelf towers 12 may be employed and that several clothes poles 14 may be used. At least one clothes pole 14 could extend only between a closet wall and a pole cup support 46 attached to a partition 22 or 24 over a corresponding pole opening 16.

Assembly may be made in any manner suited for the size of the closet and lighting conditions. For example, the bottom and top portions of the shelf tower may be assembled outside of the closet and the bottom portion could be placed in the closet first. The top portion could then be placed on and secured to the bottom portion. The shelf tower need not be located in the center of the closet to support the clothes poles 14.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

This completes the description of the preferred and alternate embodiments of the invention. Those skilled in the art may recognize other equivalents to the specific embodiment described herein which equivalents are intended to be encompassed by the claims attached hereto.

What is claimed is:

1. A pre-manufactured modular closet organizer kit of the type retrofitting into an existing closet having opposing closet walls without use of a saw, the closet organizer kit comprising:

(a) a plurality of upright panels adapted extend parallel to said closet walls and to rest on a floor of said closet, said upright panels being secured together by at least two fixed horizontal shelves between each adjacent pair of upright panels;

(b) each of said upright panels being formed with at least one opening through which a clothes pole may pass, said panel openings being aligned with each panel such that a clothes pole passing therethrough will be substantially level to said closet floor;

(c) at least one telescoping clothes pole for engaging said openings; and (d) at least one pair of clothes pole cup supports for attachment to said opposing closet walls and for supporting a clothes pole.

2. The closet organizer of claim 1 further including at least one adjustable horizontal shelf positionable between a pair of upright panels.

3. The closet organizer of claim 1 wherein said upright panels include at least one cut-out to accommodate an obstruction on a closet wall.

4. A method for organizing closet space in a closet having a left and right side walls and a back wall, comprising the steps of:

(a) assembling a pair of panels to at least two fixed shelves to form a shelf tower, said pair of panels each including at least one opening through which a clothes pole may pass, said panel openings being aligned with each panel such that a clothes pole passing therethrough will be substantially level to said closet floor when said shelf tower is positioned in an upright manner;

(c) positioning said shelf tower against the back wall of a closet;

(d) extending a telescoping clothes pole through said at least one opening in said panels until the clothes pole contacts the left and right closet walls;

(e) securing at least one pair of clothes pole cup supports to said opposing closet walls where said clothes pole contacts said closet walls; and (f) supporting said clothes pole by said clothes pole cup supports.

* * * * *